US005382053A

United States Patent [19]

Tanaka

[11] Patent Number: 5,382,053

[45] Date of Patent: Jan. 17, 1995

[54] PROTECTIVE JACKET HAVING A MAGNIFYING LENS

[76] Inventor: Yoshiya Tanaka, 25-3 Minamihanda Nakamachi, Nara-Cityi, Nara-Ken, Japan

[21] Appl. No.: 117,976

[22] Filed: Sep. 7, 1993

[30] Foreign Application Priority Data

Jun. 2, 1993 [JP] Japan ..... 5-029396
Jun. 2, 1993 [JP] Japan ..... 5-029397

[51] Int. Cl.[6] ..... B42D 9/00

[52] U.S. Cl. ..... 281/42; 281/45; 116/234; 116/240; D19/34

[58] Field of Search ..... 281/42, 45; 116/234, 116/240, 304; 33/488, 465, 471; D19/34; 428/43

[56] References Cited

U.S. PATENT DOCUMENTS

| | | | |
|---|---|---|---|
| D. 314,009 | 1/1991 | Boitani | D19/34 X |
| 2,527,071 | 10/1950 | Pierce | 116/240 X |
| 3,140,883 | 7/1964 | Anthony | D19/34 X |
| 4,259,784 | 4/1981 | MacPherson | 33/488 X |
| 5,103,758 | 4/1992 | Clark | 116/234 X |
| 5,333,907 | 8/1994 | Schaeffer | 281/42 |

FOREIGN PATENT DOCUMENTS

| | | | |
|---|---|---|---|
| 932282 | 3/1948 | France | 281/42 |
| 58-106501 | 6/1983 | Japan | 281/42 |
| 62-104798 | 5/1987 | Japan | 281/42 |
| 211119 | 8/1994 | Switzerland | 281/42 |
| 2151370 | 7/1985 | United Kingdom | 281/42 |

*Primary Examiner*—Mark Rosenbaum
*Assistant Examiner*—Frances Han
*Attorney, Agent, or Firm*—Morrison Law Firm

[57] ABSTRACT

A protective jacket includes a central panel and two end panels, at least one of which has a material strip easily removed by hand along a vertical perforation. This material strip has a circular opening at an end to hold a magnifying lens and a slotted portion at an opposite end which defines a tongue with which the material strip can be hung from a top edge of any page in a book. The material strip can thus be used as both a magnifying lens and a bookmark. A protective jacket according to a further embodiment of the present invention includes a plastic magnifying lens suspended from an interior surface of the protective jacket. An even further embodiment of the present invention includes a plastic magnifying lens suspended from the binding of a book. The present invention is not limited to books, but can be utilized with all types of printed materials, such as maps.

11 Claims, 3 Drawing Sheets

PROTECTIVE JACKET HAVING A MAGNIFYING LENS

BACKGROUND OF THE INVENTION

The present invention relates to a protective jacket, for books and other printed materials, having a magnifying lens.

It is very difficult and inconvenient for people suffering from poor eyesight, especially middle-aged persons or senior citizens, to read small typeface. Particularly, almost all dictionaries and various kinds of guide books for travel, driving, cooking or the like contain typeface so small that people suffering from poor eyesight require magnification of the typeface in order to read it. Some maps also pose difficulties for many people, regardless of the state of their eyesight, because the scales employed by cartographers on a map to depict actual distances are sometimes necessarily large.

OBJECTS AND SUMMARY OF THE INVENTION

It is therefore an object of the present invention to provide a protective jacket having a magnifying lens.

It is a further object of the present invention to provide a protective jacket having a magnifying lens that can simultaneously function as a bookmark.

It is a still further object of the present invention to provide a bookmark having a magnifying lens.

Briefly stated, a protective jacket includes a central panel and two end panels, at least one of which has a material strip easily removable by hand along a vertical perforation. This material strip has a circular opening at an end to hold a magnifying lens and a slotted portion at an opposite end which defines a tongue with which the material strip can be hung from a top edge of any page in a book. The material strip can thus be used as both a magnifying lens and a bookmark. A protective jacket according to a further embodiment of the present invention includes a plastic magnifying lens suspended from an interior surface of the protective jacket. An even further embodiment of the present invention includes a plastic magnifying lens suspended from the binding of a book. The present invention is not limited to books, but can be utilized with all types of printed materials, such as maps.

According to an embodiment of the present invention, a protective jacket having a magnifying lens comprises: a central panel receivable around an exterior of a book cover having a front and a rear cover part and a spine part connecting the front and rear cover parts, two end panels foldable against interior surfaces of the front and rear cover parts of said book cover, and a magnifying lens removably secured to the protective jacket, the magnifying lens being fixed at an end of an elongated flexible element.

According to a feature of the present invention, a magnifying lens comprises: a line piece for suspending the magnifying lens from a binding of a book, an upper end of the line piece attaching to the binding of the book at a top end of the book, and the magnifying lens attaching to a lower end of the line piece.

According to a further feature of the present invention, a protective jacket having a magnifying lens comprises: a central panel having a front and a rear cover part and a spine part connecting the front and rear cover parts, two end panels foldable against interior surfaces of the front and rear cover parts of the protective jacket, a bottom panel foldable against an interior surface of one of the front and rear cover parts of the protective jacket, a magnifying lens attached to the protective jacket, the magnifying lens being fixed at an end of an elongated flexible element.

The above, and other objects, features and advantages of the present invention will become apparent from the following description read in conjunction with the accompanying drawings, in which like reference numerals designate the same elements.

DETAILED DESCRIPTION OF THE PREFERRED EMBODIMENTS

Figure 1:
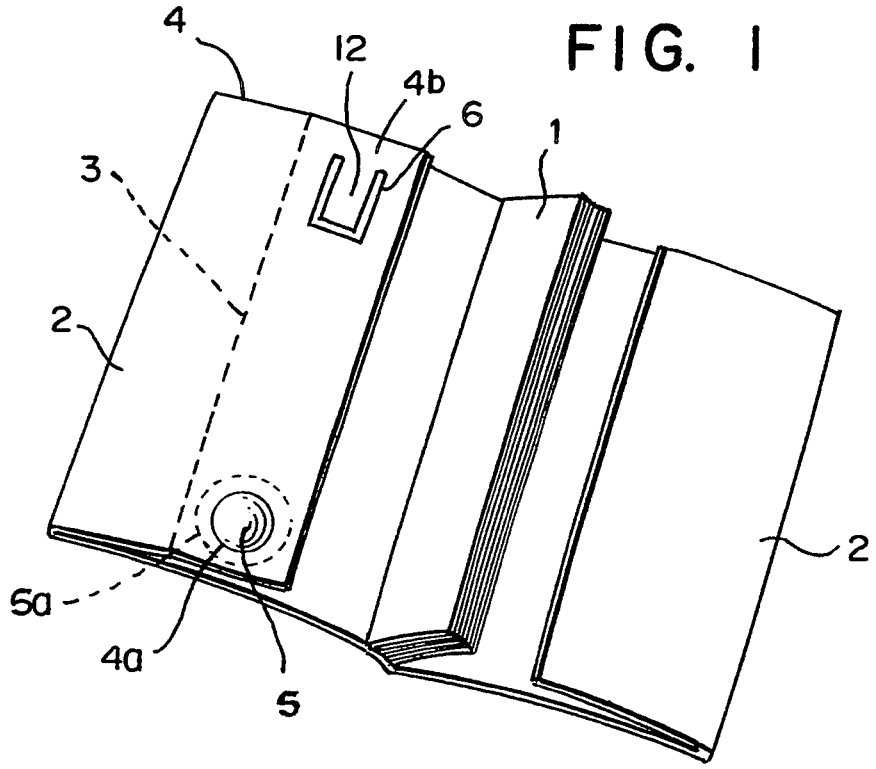
FIG. 1 is a perspective view of a preferred embodiment of the present invention.

Referring to FIG. 1, a book 1 is covered by a protective jacket 2. Two end panels 4 of protective jacket 2 are set on a back surface of a front cover and a rear cover of book 1. End panel 4 includes a material strip **4*b* which can easily be removed by hand along a vertical perforation 3** and used as a bookmark.

Figure 2:
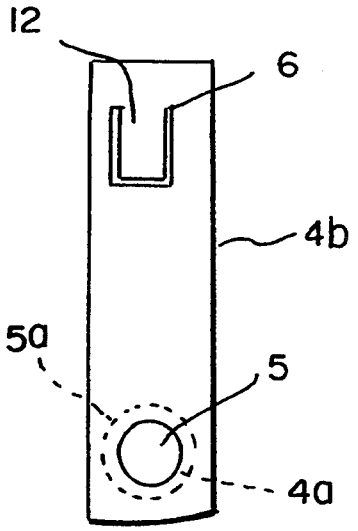
FIG. 2 is a front view of a bookmark having a magnifying lens.
Figure 3:
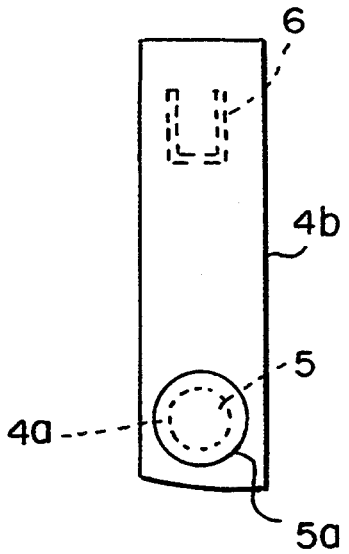
FIG. 3 is a rear view of the bookmark in FIG. 2.

Referring to FIGS. 2 and 3, a circular opening **4*a* is cut at an end of material strip 4*b* to hold a magnifying lens 5 therein. Magnifying lens 5 includes a flange portion 5*a* integrally formed therewith. A suitable adhesive fastens flange portion 5*a* to a periphery of circular opening 4*a* upon a back surface of material strip 4*b***.

A slotted part 6 at an opposite end of magnifying lens 5 is formed on an upper part of material strip **4*b* and defines a tongue 12 which clips onto a top edge of a page of book 1 to prevent material strip 4*b* from slipping off of a page that it is marking. Magnifying lens 5 enlarges small text when material strip 4*b* is held a certain distance above a page of book 1**.

The addition of magnifying lens 5 to material strip **4*b* becomes very helpful when a reader does not have access to his reading eyeglasses. When the reader clips tongue 12 onto a certain page, it is very easy to return to that page since magnifying lens 5 has a slightly greater thickness than material strip 4*b***.

Figure 4:
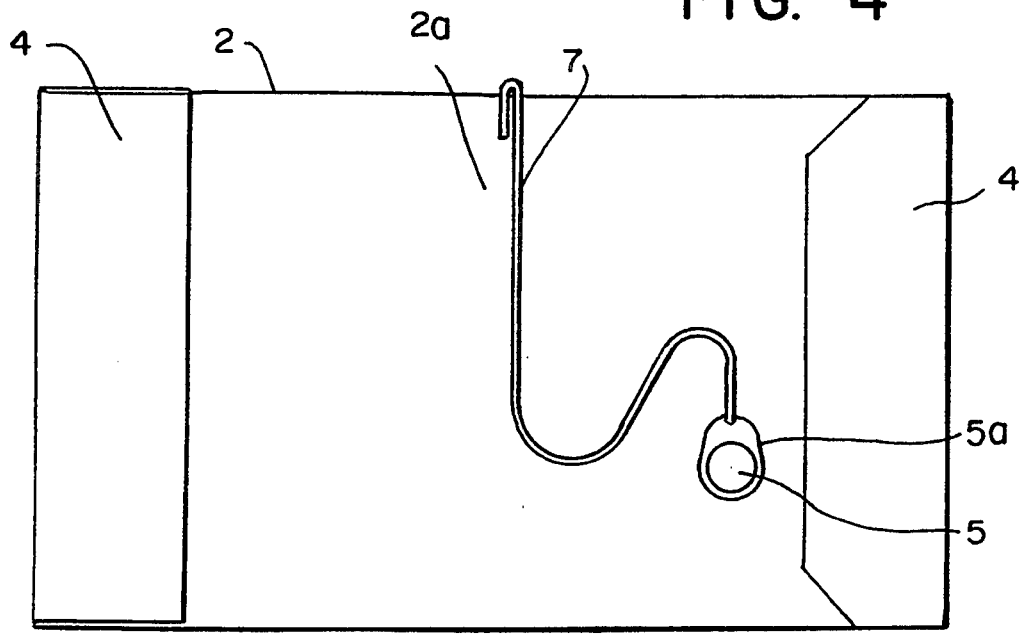
FIG. 4 is a front view of another embodiment of the present invention.

Referring to FIG. 4, in a further embodiment of the present invention, magnifying lens 5 hangs by a line piece 7 from an interior surface **2*a* of transparent protective jacket 2. Magnifying lens 5 has flange portion 5*a* integrally formed therewith. The end of line piece 7 not attached to interior surface 2*a* of protective jacket 2 is attached to an end of flange portion 5*a*. Line piece 7 is easily used as a bookmark by placing it upon a desired page of book 1 before closing book 1**.

Figure 5:
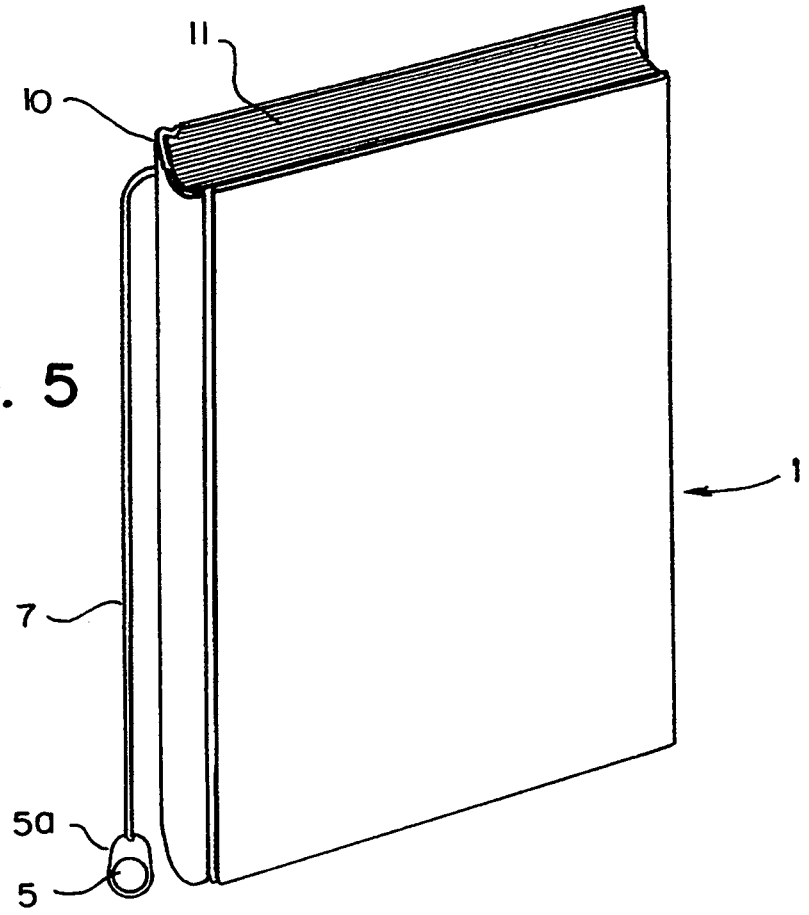
FIG. 5 is a perspective view of a further embodiment of the present invention.

Referring to FIG. 5, in an even further embodiment of the present invention, magnifying lens 5 hangs by line piece 7 from a binding 10, whereby binding 10 holds pages 11 of book 1 together. Magnifying lens 5 is integrally formed with flange portion **5*a*. The end of line piece 7 not attached to binding 10 is attached to an end of flange portion 5***a*. Line piece 7 is easily used as a bookmark by placing it upon a desired page of book 1 before closing book 1.

The present invention is not limited to books, but can be utilized with all types of printed materials, such as maps.

Figure 6:
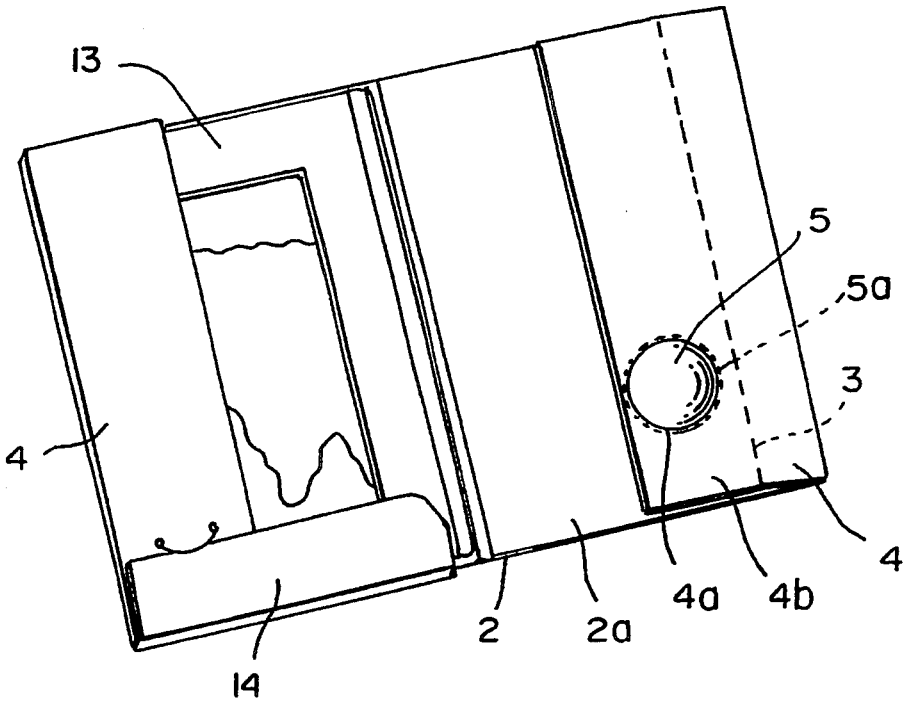
FIG. 6 is a perspective view of a further embodiment of the present invention.

Referring to FIG. 6, in a still further embodiment of the present invention, protective jacket 2 holds maps 13 in a pocket formed by folding one of two end panels 4 and a bottom panel 14 into interior surface 2*a* of protective jacket 2. A second end panel 4 is also folded into interior surface 2*a* of protective jacket 2 and includes material strip 4*b* with magnifying lens 5. Material strip 4*b* is easily detached from second end panel 4 along vertical perforation 3. Material strip 4*b* is easily removed by hand along vertical perforation 3 so that magnifying lens 5 can be used to magnify information depicted on a portion of a particular map.

Figure 7:
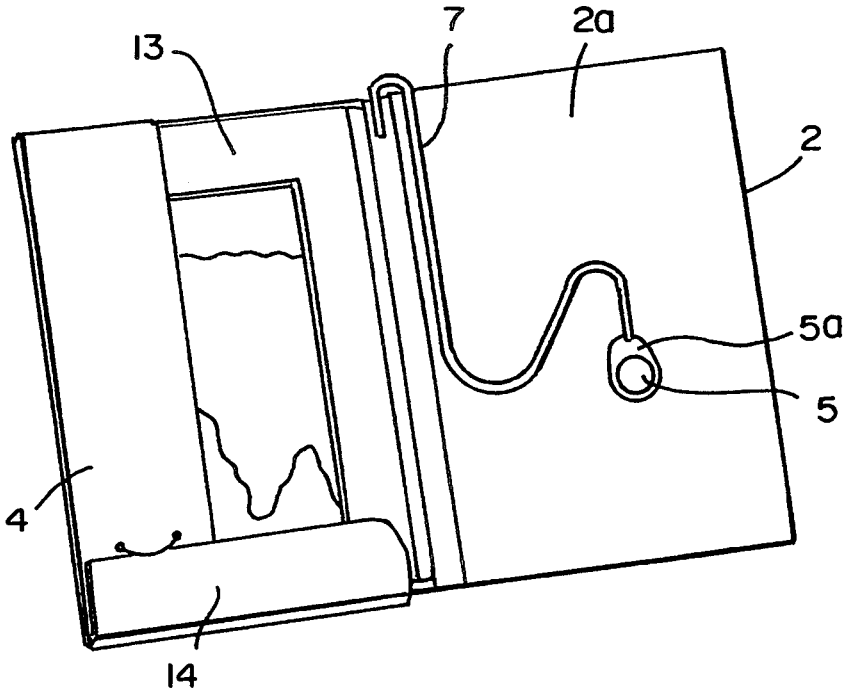
FIG. 7 is a perspective view of a further embodiment of the present invention.

Referring to FIG. 7, protective jacket 2 holds maps 13 in a pocket formed by folding end panel 4 and bottom panel 14 into interior surface 2*a* of protective jacket 2. Plastic magnifying lens 5 hangs by line piece 7 from interior surface 2*a* of protective jacket 2. Magnifying lens 5 has flange portion 5*a* integrally formed therewith. The end of line piece 7 not attached to interior surface 2*a* of protective jacket 2 is attached to an end of flange portion 5*a*.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A protective jacket having a magnifying lens, the protective jacket comprising:

a central panel receivable around an exterior of a book cover having a front and a rear cover part and a spine part connecting the front and rear cover parts, and two end panels foldable against interior surfaces of the front and rear cover parts of said book cover;

a magnifying lens attached to the protective jacket, said magnifying lens being fixed at an end of an elongated flexible element;

said flexible element being a material strip separably joined to at least one of said end panels along a vertical perforation; and said material strip, when separated from said at least one end panel, being usable as a bookmark.

2. The protective jacket of claim 1, wherein:

said magnifying lens includes a flange portion; and said flange portion of said magnifying lens is adhesively secured to a periphery of a circular opening in said material strip.

3. The protective jacket of claim 1, wherein said material strip has a slotted part adjacent an opposite part thereof which defines a tongue with which the material strip, when separated from said at least one end panel can be hung from a top edge of a book page.

4. The protective jacket of claim 1, wherein:

said flexible element is a line piece, an opposite end of the line piece attached to an interior surface of the protective jacket; and said line piece is usable as a bookmark.

5. The protective jacket of claim 4, wherein:

said magnifying lens includes a flange portion; and said flange portion of said magnifying lens is fixed to a lower end of said line piece.

6. The protective jacket of claim 1, wherein said protective jacket is made of a transparent material.

7. A protective jacket having a magnifying lens, the protective jacket comprising:

a central panel having a front and a rear cover part and a spine part connecting the front and rear cover parts;

two end panels foldable against interior surfaces of the front and rear cover parts of said protective jacket;

a bottom panel foldable against an interior surface of one of the front and rear cover parts of said protective jacket;

a magnifying lens attached to the protective jacket, said magnifying lens being fixed at an end of an elongated flexible element;

said flexible element being a material strip separably joined to at least one of said end panels along a vertical perforation; and said material strip, when separated from said at least one end panel, being usable as a bookmark.

8. The protective jacket of claim 7, wherein:

said magnifying lens includes a flange portion; and said flange portion of said magnifying lens is adhesively secured to a periphery of a circular opening in said material strip.

9. The protective jacket of claim 7, wherein said flexible element is a line piece, an opposite end of the line piece being attached to an interior surface of the protective jacket.

10. The protective jacket of claim 9, wherein:

said magnifying lens includes a flange portion; and said flange portion of said magnifying lens is fixed to a lower end of said line piece.

11. The protective jacket of claim 7, wherein said protective jacket is made of a transparent material.

* * * * *